United States Patent [19]

Deike

[11] 3,972,107

[45] Aug. 3, 1976

[54] METHOD OF FORMING SHEAR SECTIONS IN POSTS

[75] Inventor: Robert F. Deike, Cheyenne, Wyo.

[73] Assignee: Foresight Industries, Cheyenne, Wyo.

[22] Filed: June 23, 1975

[21] Appl. No.: 589,579

Related U.S. Application Data

[62] Division of Ser. No. 546,326, Feb. 3, 1975, Pat. No. 3,939,563.

[52] U.S. Cl. ..... 29/401 R; 40/125 N; 40/145 R; 52/98; 116/63 R; 404/6; 404/9; 225/2

[51] Int. Cl.[2] ..... G09F 7/00

[58] Field of Search ..... 29/401, 125 R; 30/361, 30/363, 364, 366, 367; 83/685, 691, 686, 687, 917, 692, 693; 52/98; 40/145 R, 125 N; 248/475 A, 475 B; 404/6, 9; 116/63 R; 225/2, 1, 96.5, 105

[56] References Cited

UNITED STATES PATENTS

| | | | |
|---|---|---|---|
| 1,180,357 | 4/1916 | Whitney | 30/361 |
| 1,337,947 | 4/1920 | O'Toole | 116/63 R |
| 2,630,174 | 3/1953 | Poteet | 225/2 |
| 3,308,584 | 3/1967 | Graham | 52/98 |
| 3,504,460 | 4/1970 | Solberg | 52/98 |
| 3,515,326 | 6/1970 | Saito et al. | 225/105 |
| 3,777,399 | 12/1973 | Rockel | 30/366 |

FOREIGN PATENTS OR APPLICATIONS

| | | | |
|---|---|---|---|
| 331,709 | 7/1930 | United Kingdom | 40/145 R |

*Primary Examiner*—C.W. Lanham
*Assistant Examiner*—Dan C. Crane
*Attorney, Agent, or Firm*—Hill, Gross, Simpson, Van Santen, Steadman, Chiara & Simpson

[57] ABSTRACT

Posts such as highway signs or reflector posts, exposed to impact by oncoming vehicles, are first anchored in the ground and then formed with a weakened fracture zone or shear section immediately above ground level by use of a pliers-type tool locked around the post and slidably mounting a punch which when struck by a hammer will pierce the post. The tool is positioned on the post to form the pierced hole facing the direction of oncoming traffic so that the post will break at ground level without leaving an upstanding segment when impacted by a vehicle. The invention includes the reuse of the post after it is broken off at ground level by driving the broken end of the post into the ground and then again using the tool to punch a hole in the post at the new ground level of the post.

4 Claims, 4 Drawing Figures

METHOD OF FORMING SHEAR SECTIONS IN POSTS

This is a division of application Ser. No. 546,326, filed Feb. 3, 1975, now U.S. Pat. No. 3,939,563 issued Feb. 24, 1976.

BACKGROUND OF THE INVENTION

1. Field of the Invention

This invention relates to the method of increasing the safety of highway posts and markers by the use of a hand tool which is easily locked on the post and carries a punch which when struck with a hammer will pierce a hole in the post to form a weakened fracture zone or shear section so that the post will break off at ground level when struck by a vehicle or the like. The invention particularly deals with a method of increasing the safety of highway posts.

2. Prior Art

Adjustable toggle actuated locking pliers or wrenches are known in the prior art such as for example in the expired William Petersen U.S. Pat. No. 2,417,013 issued Mar. 4, 1947 and the Christian Petersen U.S. Pat. No. 2,731,932 issued Jan. 24, 1956. Copies of these patents are filed herewith from which it will be readily apparent that these prior known locking pliers or wrenches only serve to grip or clamp work pieces.

SUMMARY OF THE INVENTION

The present invention now provides a method of increasing the safety of highway delineator or signposts alongside a highway or other location exposed to impact by vehicles or the like. According to the invention the post is driven or otherwise anchored into the ground and then has a weakened fracture area or shear section provided therein immediately above ground level by means of a vise tool gripping the post and simultaneously reinforcing it against deformation. The tool carries a prick punch which when struck by a hammer will pierce a hole of desired size in the post. The tool is positioned on the post so that the hole will be formed in the direction facing oncoming traffic or the direction of a possible impacting force. The weakened section formed by the pierced hole will cause the post to break off at ground level when struck by a vehicle or other impacting force. No portion of the post will remain upstanding to damage the under carriage or pierce the gasoline tank of the oncoming vehicle. The sheared off post section above ground is suitable for immediate reuse by driving the broken end of the post back into the ground and by then forming a new weakened fracture zone adjacent the new ground level of the post by the use of the tool.

The invention will be specifically described hereinafter in connection with the construction of the tool and the manner in which it is used. Specifically, the hand tool for carrying out the method of the invention is an adjustable toggle actuated locking pliers with jaws having semi-cylindrical gripping sleeves extending normal to the plane of punch hand grips and a tubular housing extending laterally from one of these sleeves slidably guiding a prick punch adapted to be struck by a hammer to pierce the post or other work piece embraced by the sleeves. The sleeves may be knurled or roughened to increase the frictional grip on the work piece and the punch may have a tapered piercing end and an adjustable head on the striking end to limit the extent of entry of the piercing end into the work piece thereby controlling the size of the hole formed in the work piece by the punch. The punch may be replaced with punches of variable piercing diameter.

The adjustable locking pliers have hand grip operated clamping jaws for embracing a post forming a surrounding rigid band therearound and an adjustable toggle linkage between one of the jaws and a hand grip which locks the jaws around the post. The toggle linkage includes a lever which is slidably mounted in a hand grip having an integral jaw clamp and an adjusting screw threaded through the free end of the hand grip receiving the toggle lever provides an adjustable stop for the lever thereby determining the locked position of the jaws. When the hand grips are squeezed to set the toggle linkage the jaws are locked in work piece gripping relation until the toggle lever is depressed from its locked position by a release lever carried by the hand grip to which the lever is pinned. One of the jaws, preferably the toggle actuated jaw has a tubular housing projecting laterally therefrom and a prick punch is slidably mounted through this housing presenting an inner tapered punching end to the post gripped by the locked jaws and an outer impact head adapted to be struck by a hammer to drive the punch into the work piece. An adjustable stop nut can be threaded on the outer end of the punch to control the extent of penetration of the tapered end of the punch into the work piece and thereby control the size of the hole.

It is then an object of this invention to increase the safety of highway delineator and signposts by gripping the posts at ground level with a locking pliers tool and impacting a prick punch carried by the tool to pierce the post in a direction facing oncoming traffic.

Another object of this invention is to form weakened fracture or shear sections in posts subject to impact so that they will break off at ground level without leaving an upstanding portion above ground level and may then be reused by driving the broken off end of the above level ground section back into the ground and again forming a weakened fracture zone at the new ground level of the post.

Another object of the invention is to provide a method of supporting work pieces against deformation while positioning a piercing tool to form a weakened shear section in the post.

Other and further objects of this invention will become apparent to those skilled in this art from the following detailed description of the annexed sheet of drawings which, by way of a preferred example only, illustrates a tool for carrying out the method of the invention and showing how the tool is used in the method of the invention.

DESCRIPTION OF THE PREFERRED EMBODIMENT

Figure 1:
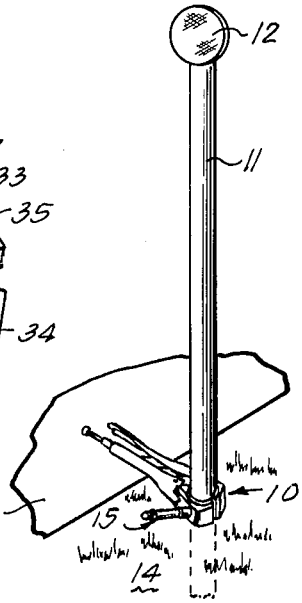
FIG. 1 is a perspective view of a highway delineator post gripped by a tool according to this invention at ground level and positioning a prick punch in the direction of on-coming traffic for quickly piercing the post to form a weakened fracture zone which will shear when the post is impacted by a vehicle.

In FIG. 1 the tool 10 is illustrated as locked on a tubular post 11 carrying a reflector 12 alongside a highway 13 and anchored in the ground 14 so that a minor portion of the post length is underground while the major portion is above ground level. The tube tool 10 slidably mounts a prick punch 15 and is positioned on the post 11 just above the level of the ground 14 with the prick punch 15 extending in the direction of on-coming traffic on the highway 13.

Figure 2:
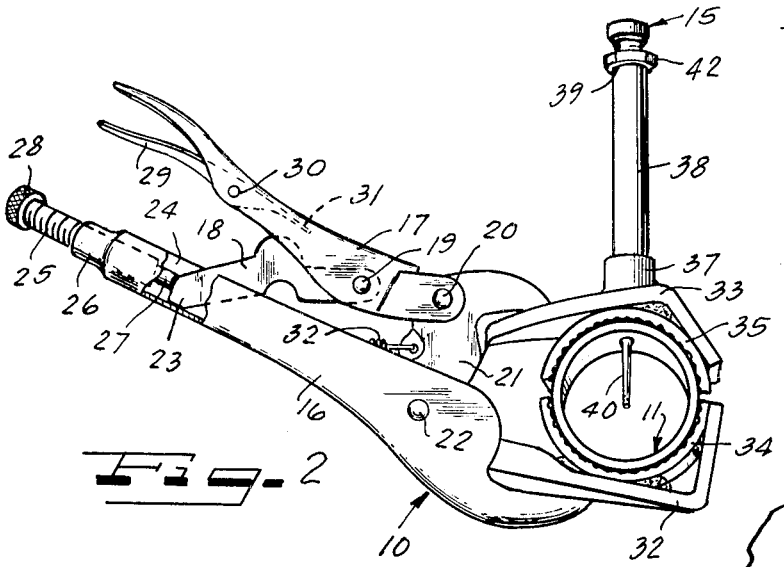
FIG. 2 is a perspective view used according to the tool of this invention for surrounding a tubular work piece shown in cross section.
Figure 3:
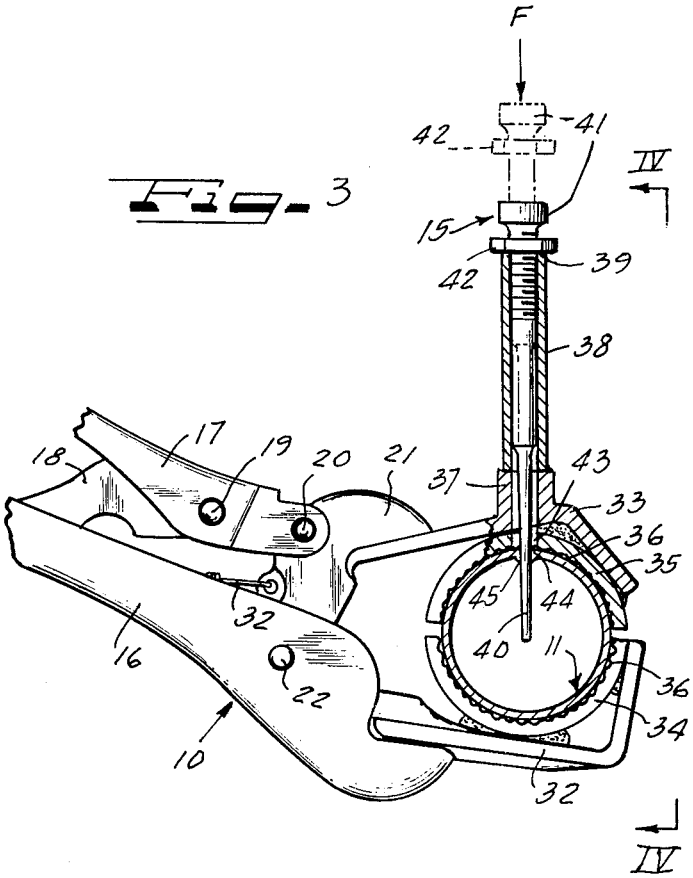
FIG. 3 is a fragmentary plan view, with parts in horizontal section used according to a portion of the tool of this invention for embracing a tubular work piece.

As shown in FIGS. 2 and 3 the tool 10 has a pair of hand grip levers 16 and 17 in opposed relation in the same plane. The grip lever 17 has an intermediate portion pivotally pinned at 19 to one end portion of a toggle link 18 and an end portion pivotally pinned at 20 to a jaw 21 which in turn is pivotally pinned at 22 to the hand grip lever 16 near one end of this lever. The toggle link 18 has a free end 23 slidably retained in a U-shaped channel 24 in the end of the hand grip lever 16 remote from the pivot pin 22. A threaded pin 25, threaded through a cylindrical end 26 of the lever 16 provides an abutment or stop 27 for the link 18. The pin 25 has a knurled head 28 for ease in manual grasping to rotate the pin and adjust the position of the stop end 27.

The grip lever 17 is U-shaped in cross section providing a longitudinal channel receiving the link 18 and also receiving a finger 29 pivotally pinned at 30 to the lever 17. The finger 29 is adapted to be depressed to engage the end 31 thereof against an intermediate portion of the link 18 for swinging the lever 17 out of toggle locking position.

A tension spring 32 anchored in the lever 16 pulls the jaw 21 to an open or unlocked position.

The grip lever 16 fixedly mounts a C-shaped jaw 32 beyond the pin 22. An opposing C-shaped jaw 33 is fixedly mounted on the free end of the jaw 21.

Figure 4:
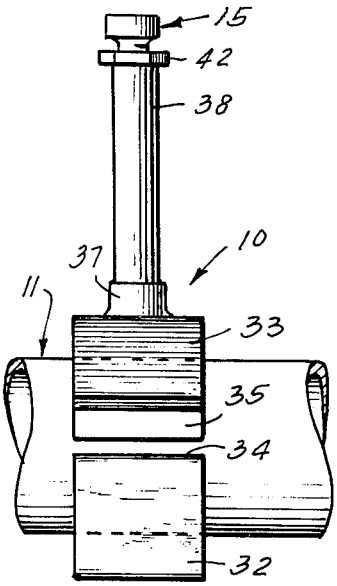
FIG. 4 is a front end elevational view of the tool and work piece taken along the line IV—IV of FIG. 3.

The jaw 32 fixedly mounts a fragmental cylindrical sleeve 34 while the jaw 33 fixedly mounts an opposing fragmental cylindrical sleeve 35. The sleeves 34 and 35 extend normal to the plane of the hand levers 16 and 17 and may be coextensive in length with the width of the jaws 32 and 33 as shown in FIG. 4. The inner peripheries of these sleeves 34 and 35 are knurled or otherwise roughened at 36. As shown, the sleeves 34 and 35 are sized to surround the post 11 with the roughened inner peripheries 36 thereof tightly engaging the outer periphery of the post.

The jaw 33 has a laterally outwardly extending nipple or boss 37 mounting a cylindrical tubular housing 38 with an open outer end 39 through which is inserted the prick punch 15 having a tapered piercing inner end 40 and a head 41 at the opposite end beyond the housing 38. A stop nut 42 is threaded on the outer end of the punch 15 under the head 41 to engage the outer open end 39 of the housing 38 and limit the penetration of the punch into the housing.

The pointed or tapered end 40 of the punch 15 is slidably guided in the housing 38 and extends freely through the nipple 37 and through an aperture 43 in the sleeve 35 to engage the post 11. When the head 41 of the punch 15 is struck by a hammer, the pointed end 40 of the punch will pierce the work piece gripped by the sleeves 34 and 35 forming a hole 44 through the work piece surrounded by a ferrule or burr 45. The sleeves 34 and 35 snugly surround and grip the post 11 reinforcing it against deformation when pierced by the punch. The stop nut 42 is positioned on the punch 15 to engage the open end 39 of the housing 38 to limit the penetration of the tapered end 40 of the punch 15 into the post 11 thereby determining the size of the hole 44 and preventing the leading end of the punch from reaching the portion of the interior of the post 11 lying diametrically opposite the hole 44.

In use, the toggle adjusting pin 25 is positioned so that its stop end 27 will engage the free end of the toggle link 18 with the sleeves 34 and 35 tightened around the post 11 just before the link 18 reaches its toggle locking position whereupon a further squeezing of the grip lever 17 will align the pivot pins 19 and 20 with the end of the link 18 and moving the toggle linkage to its locked position. Then the finger 29 may be depressed to effect relative movement between the lever 17 and the link 18 to unlock the toggle.

It will, therefore, be appreciated that the tool 10 is easily and quickly mounted on and locked to the post 11 at the exact desired position for centering the prick punch 15 and that the punch is then struck by a hammer to pierce the work piece at the exact location determined by the tool. This preferred position for highway posts as described in FIG. 1 is to lock the tool around the post immediately above ground level with the prick punch extending in the direction to face on-coming traffic on the highway 13.

From the above descriptions it should be clear that this invention provides a convenient method of forming weakened shear sections or fracture zones in work pieces such as posts to cause them to break off at ground level when impacted by a vehicle or the like so as to avoid heretofore encountered upstanding post sections which can damage vehicles traveling thereover after impact. The method of the invention uses a hand tool serving both as a vise, and a post reinforcing support and slidably mounting a prick punch which will pierce the post to form the weakened shear section.

I claim:

1. The method of increasing the safety of hollow highways posts after they are mounted in the ground alongside a highway which comprises surrounding the portion of the post just above ground level with gripping jaws reinforcing the post against deformation driving a punch into the jaw surrounded portion of the post to form a hole in the one side of the post facing in the direction of on-coming traffic on the highway, thereby forming a weakened shear section at ground level of the post, withdrawing the punch from the post, and releasing the jaws from the post.

2. The method of claim 1 including the steps of controlling the gripping jaws on the post with toggle locking pliers having a punch extending laterally from one of the jaws, rotating the pliers on the post to position the punch in the direction of on-coming highway traffic, locking the gripping jaws on the post, driving the punch into the jaw surrounded post portion forming a hole in the post facing the highway traffic, retracting the punch from the post, and removing the pliers from the post.

3. The method of claim 1 including ground anchoring the broken off leading end of the post after the post has been sheared and forming a new hole in the broken post facing traffic adjacent ground level.

4. The method of forming shear sections in hollow work pieces which comprises surrounding the work piece at the area to form the shear section with a rigid support preventing deformation of the work piece, slidably guiding a tapered prick punch in the support positioning the prick punch to engage the work piece at the zone to form the shear section, driving the prick punch into the work piece to a depth for forming a hole of desired size in one side of the work piece, withdrawing the punch from the work piece, and removing the support from the work piece.

* * * * *